United States Patent [19]

Williams, Jr.

[11] 4,132,265

[45] Jan. 2, 1979

[54] PIPE SHEARING RAM ASSEMBLY FOR BLOWOUT PREVENTER

[75] Inventor: Leonard E. Williams, Jr., Houston, Tex.

[73] Assignee: Cameron Iron Works, Inc., Houston, Tex.

[21] Appl. No.: 893,976

[22] Filed: Apr. 6, 1978

[51] Int. Cl.[2] ..... E21B 29/00

[52] U.S. Cl. ..... 166/55; 251/1 A; 137/242

[58] Field of Search ..... 166/55, 55.1, 55.2, 166/55.3; 251/1 R, 1 A; 137/242; 30/92

[56] References Cited

U.S. PATENT DOCUMENTS

| | | | |
|---|---|---|---|
| 2,238,357 | 4/1941 | Allen | 251/1 A |
| 2,919,111 | 12/1959 | Nicolson | 166/55 X |
| 2,969,838 | 1/1961 | Wilde | 166/55 |
| 3,379,255 | 4/1968 | Burns, Jr. et al. | 166/55 |
| 3,561,526 | 2/1971 | Meynier | 166/55 |
| 3,736,982 | 6/1973 | Vujasinovic | 166/55 |
| 3,817,326 | 6/1974 | Meynier | 166/55 |
| 3,841,347 | 10/1974 | Kushida | 137/242 |
| 3,938,541 | 2/1976 | Polacheck et al. | 137/242 |

*Primary Examiner*—Ernest R. Purser
*Assistant Examiner*—Richard E. Favreau
*Attorney, Agent, or Firm*—Vinson & Elkins

[57] ABSTRACT

A shear ram assembly for a blowout preventer having a pair of rams with opposed shear blades, means for moving the shear blades across the pipe opening of a blowout preventer, a face seal on one of said rams and a shoulder above said face seal, the forward face of the shear blade of the other ram coacting with the shoulder to move a cut pipe section out of its path and also being shaped to enter into sealing engagement with the face seal, and a debris drain through the blade of said one ram to allow debris to move out of the path of the sealing face of the shear blade of the other ram toward the face seal.

7 Claims, 4 Drawing Figures

Fig. 3
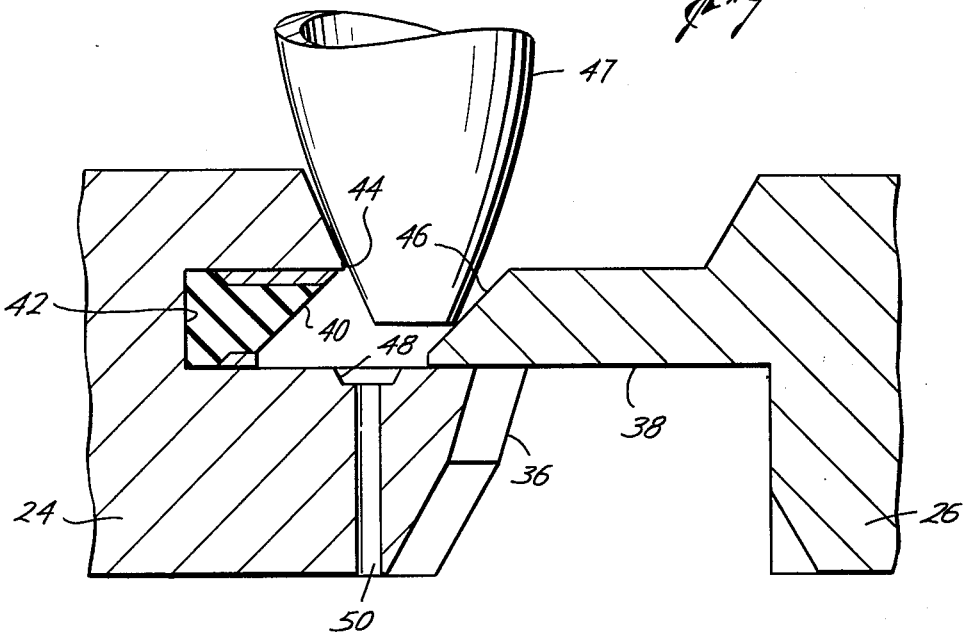
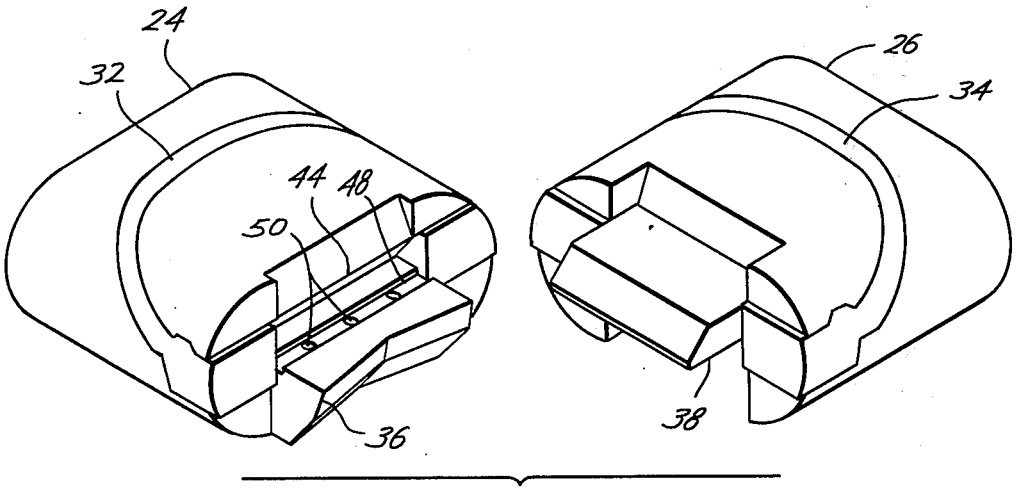
Fig. 4

PIPE SHEARING RAM ASSEMBLY FOR BLOWOUT PREVENTER

BACKGROUND

Prior art blowout preventer shear rams include a type in which a seal is provided for the face or faces of the shear blades to seal against (U.S. Pat. No. 3,561,526 to L. E. Williams, Jr. et al) and another type in which the seal for the blades is contained in a recess in one of the blades to seal against the other shear blade along the shear plane (U.S. Pat. No. 3,817,326 to M. J. Meynier III and U.S. Pat. No. 3,736,982 to A. N. Vujasinavic). For each time these rams are operated to shear, they are operated a great number of times to act as blind rams. The serice life of such shear rams is limited by excessive ram packing forces which result from limited packing area and the excessively wide crack between confronting blade surfaces which is bridged by packing. Also with the prior art pipe shear rams for blowout preventers little attention is given to assure that the pieces of the sheared pipe do not interfere with the sealing.

SUMMARY

The present invention relates to an improved shear ram assembly for a blowout preventer.

The improved shear ram assembly includes a pair of opposed rams with shear blades, one of the rams having a shear blade, a face seal and a shoulder, the other of said rams having a shear blade with a leading or forward face which is shaped to seal against said face seal and to coact with said shoulder to move the section of sheared pipe out of its path. Also, a drain is provided through the lower shear blade to allow debris and metal particles to fall therethrough and thus not interfere with the face seal.

This structure minimizes wear on the seal and avoids having to seal around pipe ends and metal debris.

BRIEF DESCRIPTION OF THE DRAWINGS

These and other advantages of the improved structure of the present invention are hereinafter set forth and explained with reference to the drawings wherein:

FIG. 3 is a partial detailed sectional view of the shear blades following the pipe shearing to show the movement of the sheared pipe section out of the path of the shear blade sealing face.

FIG. 4 is an isometric view of the ram assembly.

DESCRIPTION OF THE PREFERRED EMBODIMENT

Figure 1:
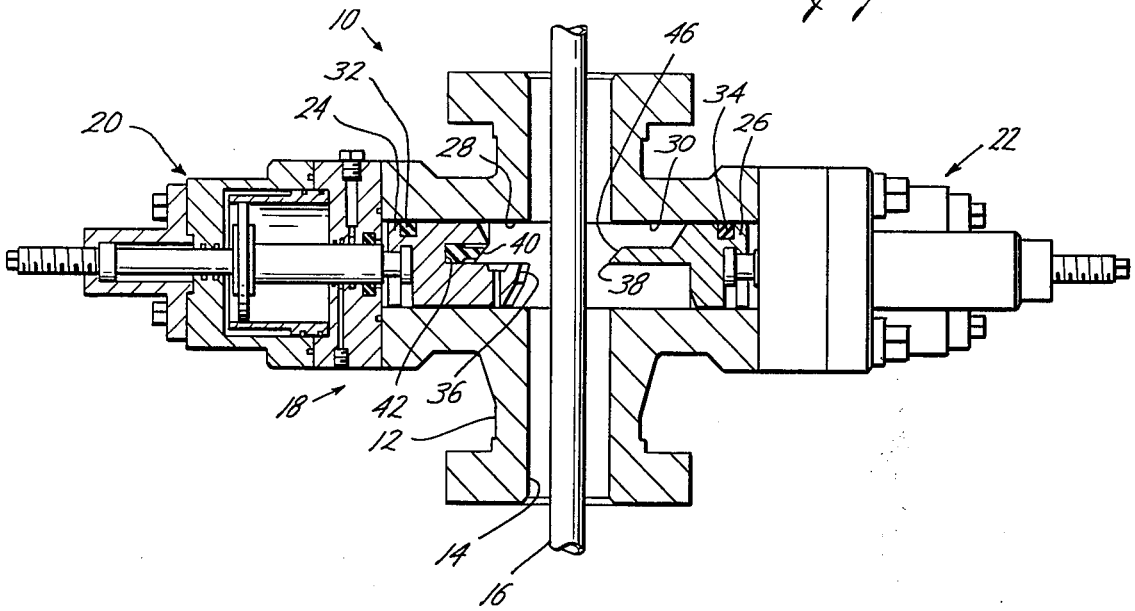
FIG. 1 is a side view partially in section of a blowout preventer having the improved ram assembly of the present invention in retracted position.

The blowout preventor 10 shown in FIG. 1 is generally of the usual design including the body 12 having the pipe bore 14 through which pipes such as 16 are adapted to extend, the improved shear ram assembly 18 of the present invention and the pressure responsive means 20 and 22 for moving the rams 24 and 26 toward each other into sealed position closing pipe bore 14 and for retracting the rams 24 and 26 from such position.

Figure 2:
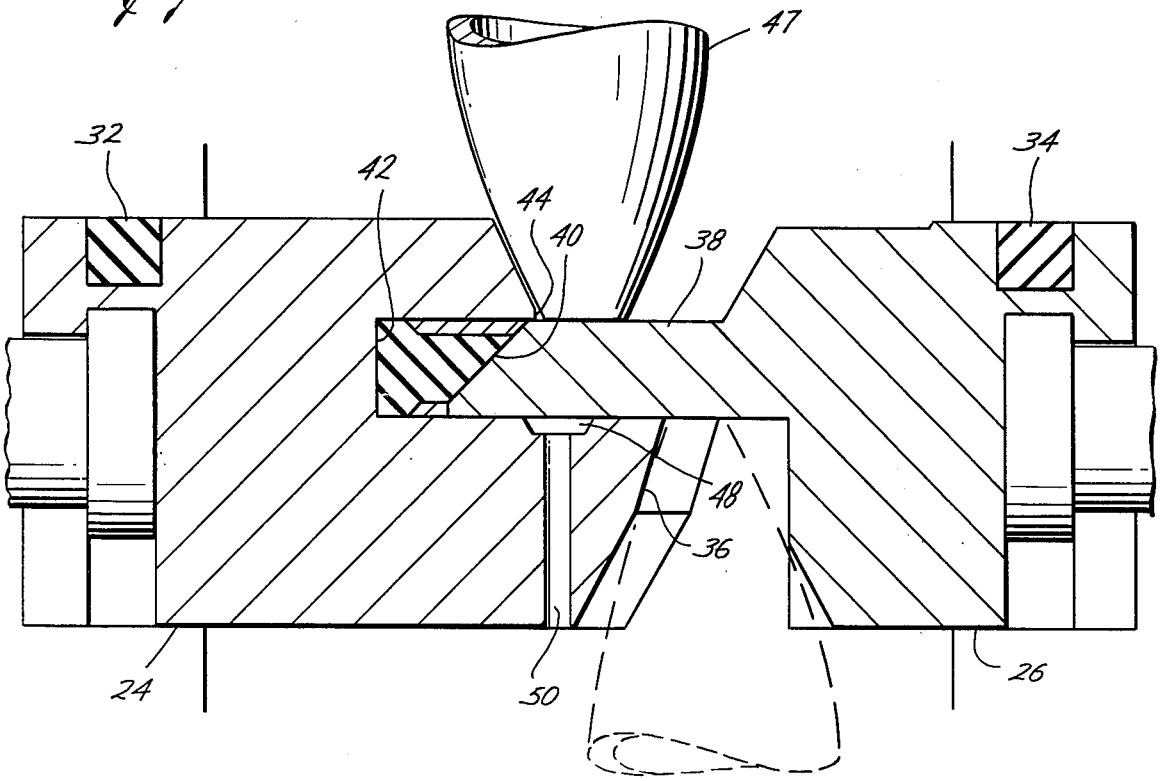
FIG. 2 is a detail sectional view of the shear blades in sealed position following the shearing of a pipe.

The rams 24 and 26 are slidable in the guideways 28 and 30 within body 12 and are provided with suitable sealing means 32 and 34. The ram 24 has shear blade 36 projecting toward ram 26 which has the projecting shear blade 38. Both shear blades 36 and 38 are of the well known design with the central portion of at least one blade recessed and the side portions extending toward the other ram to provide some centering of the pipe 16 as the rams close thereon. This blade contour is shown in FIG. 4 and is similar to the blades disclosed in the aforementioned Meynier U.S. Pat. No. 3,817,316. Blade 36 coacts with blade 38 to shear pipe 16, as shown in FIG. 2 along the shearing plane which is established along the upper surface of blade 36 and along the lower surface of blade 38. The shearing plane may actually allow a small gap between the upper and lower blades to avoid interference thereof.

Ram 24 includes the face seal 40 positioned within recess 42 and the shoulder 44 immediately above face seal 40. Shoulder 44 is positioned to coact with the forward or leading face 46 of shear blade 38 to lift or wedge the cut section 47 of pipe 16 upward out of the path of shear blade 38 so that its face 46 can seal against the face seal 40.

In shearing pipe small pieces of metal may break loose from the pipe section 47 and collect on the upper surface of shear blade 36. Such debris if not properly handled could interfere with the blade face sealing. It has been suggested that the upper surface of blade 36 include a groove 48. With such groove 48 these small pieces of metal fall therein and are out of the path of blade 38 toward seal 40. I would provide at least one drain hole 50 (preferably a plurality of drain holes) extending through blade 36 to drain debris collecting in groove 48 downward into the bore 14 to assure that excess debris does not fill and overflow groove 48 and thus interfere with the face sealing.

Shear blade 38 projects outward from ram 26 to provide a recess below the upper shear blade 38 so that the lower section of cut pipe has a recess in which it may be positioned after shearing. It is also peferred that the ram 26 provide a recess above the upper shear blade 38 in which the upper cut section of pipe may be positioned if it is not raised after shearing by the tension in pipe 16.

The improved blowout preventer of the present invention thus provides improved ram assemblies with a face seal which avoids the problem of rams moving across seals and also eliminates the interference of the cut pipe section and debris with the face seal.

What is claimed is:

1. A blowout preventer comprising, a body having a pipe opening therethrough, ram guideways extending laterally from opposite sides of the pipe opening, a ram assembly comprising a pair of rams, each located in one of the ram guideways, and means for moving the rams together to close off the pipe opening and for moving the rams apart to open the pipe opening, each ram having a shear blade in position for the shearing edge of the blade on one ram to pass just below the shearing edge of the blade on the other ram to shear any pipe positioned in the pipe opening when the rams are moved together to close off the opening, seal means on one of said rams including a seal positioned to be engaged and compressed by the shear blade of the other ram when the rams are extended to form a seal, and a shoulder on the ram having the lower shear blade, a recess below said upper shear blade, said seal means being positioned above the upper surface of said lower shear blade and below said shoulder, pipe forcing means including a wedge shape on the leading edge of the upper shear blade which coacts with said shoulder on said lower shear blade to raise the sheared pipe above the lower shear blade out of the path between said lower shear blade and said seal means.

2. A blowout preventer according to claim 1, including a recess above said upper shear blade.

3. A blowout preventer according to claim 1 wherein the wedge shape on the leading edge of the upper shear blade forms an angle with the shear plane of not more than 45°.

4. A blowout preventer according to claim 3 including a transverse groove in the upper surface of said lower shear blade whereby debris is received therein to clear the path of the upper shear blade for sealing with said seal means, and drain means communicating with said groove and extending through said lower shear blade whereby debris collecting in said groove may pass through said drain holes into the pipe opening below said lower shear blade.

5. A shear ram assembly for a ram type blowout preventer, comprising a pair of rams, each ram having a shear blade attached thereto in position for the shearing edge of the blade on one ram to pass just below the shearing edge of the blade on the other ram to shear any pipe positioned in the pipe opening when the rams are moved together to close off the opening, seal means on one of said rams positioned to be engaged and compressed by the shear blade of the other ram when the rams are extended to form a seal, and a shoulder on the ram having the lower shear blade, a recess above said upper shear blade, said seal means being positioned above the upper surface of said lower shear blade, and pipe forcing means including a wedge shape on the leading edge of the upper shear blade which coacts with said shoulder to raise the sheared pipe above the lower shear blade out of the path between said lower shear blade and said seal means.

6. A shear ram assembly according to claim 5 wherein the wedge shape on the leading edge of the upper shear blade forms an angle with the shear plane of not more than 45°.

7. A shear ram assembly according to claim 6, including a transverse groove in the upper surface of said lower shear blade whereby debris is received therein to clear the path of the upper shear blade for sealing with said seal means, and drain means communicating with said groove and extending through said lower shear blade whereby debris collecting in said groove may pass through said drain holes into said pipe opening below said lower shear blade.

* * * * *